US008965012B1

(12) United States Patent
Dong et al.

(10) Patent No.: US 8,965,012 B1
(45) Date of Patent: Feb. 24, 2015

(54) SMART SENSING BONE CONDUCTION TRANSDUCER

(71) Applicant: Google Inc., Mountain View, CA (US)

(72) Inventors: Jianchun Dong, Palo Alto, CA (US); Eliot Kim, Cupertino, CA (US)

( * ) Notice: Subject to any disclaimer, the term of this patent is extended or adjusted under 35 U.S.C. 154(b) by 54 days.

(21) Appl. No.: 13/779,705

(22) Filed: Feb. 27, 2013

(51) Int. Cl.
*H04R 25/00* (2006.01)
*H04R 1/46* (2006.01)

(52) U.S. Cl.
CPC ..... *H04R 1/46* (2013.01)
USPC ..... 381/151

(58) Field of Classification Search
USPC ..... 381/151, 326, 380
See application file for complete search history.

(56) References Cited

U.S. PATENT DOCUMENTS 5,771,298 A * 6/1998 Davis et al. ..... 381/60
6,839,443 B2 * 1/2005 Fukuda ..... 381/151

FOREIGN PATENT DOCUMENTS

JP 09-270186 A 10/1997
WO 2012/042572 A1 4/2012

OTHER PUBLICATIONS

Ladyada,"Force Sensitive Resistor", Aug. 13, 2012, Adafruit Industries.
T. Hertsens, "AfterShokz and TEAC Filltune HP-F100 Bone Conduction Headphones", Mar. 15, 2012.
M.J.Whelan et al.,"Real-Time Embedded Sensing for Process Monitoring and Quality Control in the Lost Foam Casting Process", Transactions of the American Foundry Society, 2007.

* cited by examiner

*Primary Examiner* — Davetta W Goins
*Assistant Examiner* — Amir Etesam

(57) ABSTRACT

Example methods and devices are provided related to bone conduction. A bone conducting transceiver (BCT) is provided. The BCT includes a metal spring, an anvil, a base, and at least one sensor. The metal spring has two ends. The anvil is mounted on an upper surface of the metal spring and is configured to move in conjunction with the metal spring based on an input signal. The base contacts a lower surface of the metal spring and supports at least one end of the two ends of the metal spring. The at least one sensor is configured to generate data regarding at least one characteristic of the BCT.

18 Claims, 11 Drawing Sheets

500

SMART SENSING BONE CONDUCTION TRANSDUCER

BACKGROUND

Unless otherwise indicated herein, the materials described in this section are not prior art to the claims in this application and are not admitted to be prior art by inclusion in this section.

Computing devices such as personal computers, laptop computers, tablet computers, cellular phones, and countless types of Internet-capable devices are increasingly prevalent in numerous aspects of modern life. Over time, the manner in which these devices are providing information to users is becoming more intelligent, more efficient, more intuitive, and/or less obtrusive.

The trend toward miniaturization of computing hardware, peripherals, as well as of sensors, detectors, and image and audio processors, among other technologies, has helped open up a field sometimes referred to as "wearable computing." In the area of image and visual processing and production, in particular, it has become possible to consider wearable displays that place a "near-eye display" element close enough to a wearer's eye(s) such that a displayed image is perceived by the wearer.

Wearable computing systems can be configured to be worn proximate a wearer's head to allow for interfacing with the wearer's audible and/or visual senses. For example, a wearable computing system can be implemented as a helmet or a pair of glasses. To transmit audio signals to a wearer, a wearable computing system can function as a hands-free headset or as headphones, employing speakers to produce sound. Audio transducers are employed in microphones and speakers. A typical audio transducer converts electrical signals to acoustic waves by sending the electrical signals through a coil to produce a time-varying magnetic field which operates to move a small magnet connected to a membrane. The time-changing magnetic fields vibrate the magnet, which vibrates the membrane, and results in sound waves traveling through air. An acoustic transducer can also translate sound waves to electrical signals by a similar process using a pressure sensitive membrane to create a time-changing magnetic field that produces an electrical signal in a coil of wire, such as in a microphone.

Sound perception in the biological realm, such as in human ears, also involves converting acoustic waves to electrical signals. For conventional sound perception, incoming acoustic waves are directed by the outer ear toward the ear canal where the tympanic membrane (ear drum) is stimulated to vibrate in accordance with the received acoustic pressure wave. The pressure wave information is then translated and frequency shifted by ossicles, which are three small bones in the middle ear. The ossicles mechanically stimulate another membrane separating the fluid-filled chamber of the inner ear, which includes the cochlea. Hairs lining the interior of the cochlea act as frequency-specific mechanotransducers that are stimulated by the pressure wave transmitted through the fluid in the cochlea. The stimulated hairs then activate neurons to send signals to the brain allowing for perception of sound.

Bone conduction transducers create sound perception by directly stimulating the ossicles and effectively bypassing the outer ear. Bone conduction transducers couple to a bony surface on the skull or jaw, such as the mastoid bone surface behind the ear, to create vibrations that propagate to the ossicles, and thereby allow for sound perception without directly vibrating the tympanic membrane. A bone conduction transducer transmits vibrations to the inner ear by a vibrating anvil placed on a bony structure of the skull or jaw. Such a bone conduction transducer can include an anvil suitable for making contact with a bony portion of the head can be mounted to a transducer, which can vibrate the anvil according to received electrical signals.

SUMMARY

In one aspect, a bone conducting transceiver (BCT) is provided. The bone conducting transceiver includes a metal spring, an anvil, a base, and at least one sensor. The metal spring has two ends. The anvil is mounted on an upper surface of the metal spring and is configured to move in conjunction with the metal spring based on an input signal. The base contacts a lower surface of the metal spring and supporting at least one end of the two ends of the metal spring. The at least one sensor is configured to generate data regarding at least one characteristic of the BCT.

In another aspect, a method is provided. A computing device receives data at a pre-determined range of frequencies for a BCT. The computing device determines a signal characteristic for a signal based on the data. At least part of the BCT is configured to vibrate based on the signal. The computing device generates the signal based on the signal characteristic. The computing device communicates the signal to the BCT.

In yet another aspect, a computing device is provided. The device includes a processor and a non-transitory computer-readable storage medium. The non-transitory computer-readable storage medium is configured to store at least instructions thereon that, upon execution by the processor, cause the computing device to perform functions. The functions include: (a) receiving data at a pre-determined range of frequencies for a BCT; (b) determining a signal characteristic for a signal based on the data, where at least part of the BCT is configured to vibrate based on the signal; (c) generating the signal based on the signal characteristic; and (d) communicating the signal to the BCT.

These as well as other aspects, advantages, and alternatives, will become apparent to those of ordinary skill in the art by reading the following detailed description, with reference where appropriate to the accompanying drawings.

DETAILED DESCRIPTION

Introduction

Figure 1A:
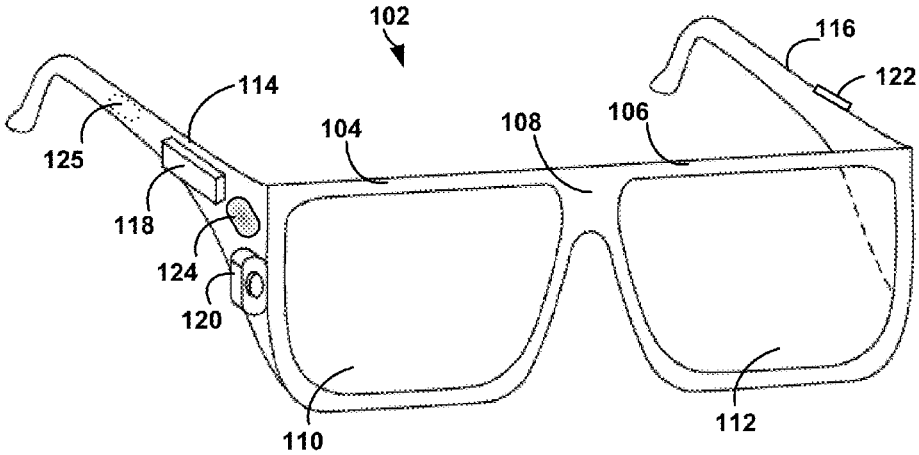
FIG. 1A illustrates a wearable computing system according to an example embodiment.

Example methods and systems are described herein. It should be understood that the word "exemplary" is used herein to mean "serving as an example, instance, or illustration." Any embodiment or feature described herein as "exemplary" is not necessarily to be construed as preferred or advantageous over other embodiments or features. The example embodiments described herein are not meant to be limiting. It will be readily understood that certain aspects of the disclosed systems and methods can be arranged and combined in a wide variety of different configurations, all of which are contemplated herein.

A BCT is designed to receive audio signals, perhaps via a wire, and produce corresponding oscillations in a metal diaphragm or "anvil" of the BCT driven by a metal spring. When placed in direct or indirect contact with skin covering a bony structure of the head, the oscillating anvil creates vibrations that propagate via the skull to the inner ear and cause sound to be perceived. Vibrations from BCTs contacting other bones than the skull; e.g., the jawbone, or similar structures, such as the cartilage supporting the ear, can cause sound to be perceived as well.

In an example BCT, an electromagnet is formed by wire coiled around a core and operated according to the input signals to produce a time changing magnetic field sufficient to vibrate the anvil. Permanent magnets are located on opposing sides of the electromagnet to bias the anvil and/or magnetize ferromagnetic components of the anvil such that the anvil can be both attracted and repelled by the variations of the electromagnet. The anvil can be elastically suspended over the electromagnet to allow for translation due to the combined magnetic forces acting on according to the input signals.

A BCT can potentially be improved by enabling adjustment of BCT performance dependent on a surface contacting the BCT. For example, BCT performance may be improved when a vibrating surface of the BCT is in contact with skin of a user or wearer of the BCT. As mentioned above, the BCT can be utilized in a device that touches or is close to a head of the user or wearer, such as a mobile device or wearable computing device.

The BCT output can be measured to determine whether the BCT is contact with a surface. For example, one or more characteristics of the BCT, such as electrical characteristics and/or resonant frequencies, can change based on BCT contact. These characteristic(s) can be measured during BCT operation, and data about the measured characteristic(s) can be provided to a computing device. The computing device can use the measured BCT characteristic(s) to adjust properties of signals provided as input signals to the BCT accordingly. For example, if the computing device determines the BCT is in contact with a surface, such as skin, the computing device can provide input signals with relatively high gain or power, but can provide lower gain/less powerful signals when the computing device determines the BCT is not in contact with a surface; e.g., the BCT is not in contact with the wearer.

Further, the computing device can determine if it is on a surface, such as the user's head, by sensing whether the BCT is in contact with the surface. If the computing device determines it is not in contact with a surface, the computing device can enter a "low duty cycle" to conserve power. For example, during the low duty cycle, the computing device can shut down one or more components of the computing device, such as a display, and/or other circuitry, and adjust parameters to reduce power, such as reducing cycle times for checking for input.

Current BCTs also can produce sound with an audible amount of "sound leakage"; that is, the BCT can emit vibrations perceivable as sound by nearby persons not utilizing the BCT. As sound leakage can be annoying, the BCT can be configured to reduce or eliminate vibrations emitted from portions of the BCT not meant to be in contact with the wearer or user. For example, sidewalls and/or a base of the BCT can be fashioned partially or completely out of sound-absorbing materials, such as but not limited to rubber and/or foam. Using BCTs with sidewalls and bases made of sound-absorbing can significantly decrease or eliminate vibrations that lead to sound leakage.

Thus, gain or power of input signals to a BCT configured to provide information about BCT contact can be adjusted based on a determination that the BCT is in contact with a surface. This technique can provide for more efficient use of power provided to the BCT, and in some cases, reduce sound leakage by utilizing lower-power signals when in the BCT is not in direct skin contact. Further, sound leakage can be significantly decreased or eliminated by use of sound-absorbing materials in the sidewalls and/or the base of the BCT. These techniques can make BCTs more desirable to use by making them more efficient and less subject to sound leakage.

Examples of Wearable Computing Systems

Systems and devices in which example embodiments may be implemented will now be described in greater detail. In general, an example system may be implemented in or may take the form of a wearable computer (also referred to as a wearable computing device). In an example embodiment, a wearable computer takes the form of or includes a head-mountable device (HMD).

An example system may also be implemented in or take the form of other devices, such as a mobile phone, among other possibilities. Further, an example system may take the form of non-transitory computer readable medium, which has program instructions stored thereon that are executable by at a processor to provide the functionality described herein. An example system may also take the form of a device such as a wearable computer or mobile phone, or a subsystem of such a device, which includes such a non-transitory computer readable medium having such program instructions stored thereon.

An HMD may generally be any display device that is capable of being worn on the head and places a display in front of one or both eyes of the wearer. An HMD may take various forms such as a helmet or eyeglasses. As such, references to "eyeglasses" or a "glasses-style" HMD should be understood to refer to an HMD that has a glasses-like frame so that it can be worn on the head. Further, example embodiments may be implemented by or in association with an HMD with a single display or with two displays, which may be referred to as a "monocular" HMD or a "binocular" HMD, respectively.

FIG. 1A illustrates a wearable computing system according to an example embodiment. In FIG. 1A, the wearable computing system takes the form of HMD 102 (which may also be referred to as a head-mounted display). It should be understood, however, that example systems and devices may take the form of or be implemented within or in association with other types of devices, without departing from the scope of the invention. As illustrated in FIG. 1A, the HMD 102 includes frame elements including lens-frames 104, 106 and a center frame support 108, lens elements 110, 112, and extending side-arms 114, 116. The center frame support 108 and the extending side-arms 114, 116 are configured to secure the HMD 102 to a user's face via a user's nose and ears, respectively.

Each of the frame elements 104, 106, and 108 and the extending side-arms 114, 116 may be formed of a solid structure of plastic and/or metal, or may be formed of a hollow structure of similar material so as to allow wiring and component interconnects to be internally routed through the HMD 102. Other materials may be possible as well.

One or more of each of the lens elements 110, 112 may be formed of any material that can suitably display a projected image or graphic. Each of the lens elements 110, 112 may also be sufficiently transparent to allow a user to see through the lens element. Combining these two features of the lens elements may facilitate an augmented reality or heads-up display where the projected image or graphic is superimposed over a real-world view as perceived by the user through the lens elements.

The extending side-arms 114, 116 may each be projections that extend away from the lens-frames 104, 106, respectively, and may be positioned behind a user's ears to secure the HMD 102 to the user. The extending side-arms 114, 116 may further secure the HMD 102 to the user by extending around a rear portion of the user's head. Additionally or alternatively, for example, the HMD 102 may connect to or be affixed within a head-mounted helmet structure. Other configurations for an HMD are also possible.

The HMD 102 may also include an on-board computing system 118, an image capture device 120, a sensor 122, and a finger-operable touch pad 124. The on-board computing system 118 is shown to be positioned on the extending side-arm 114 of the HMD 102; however, the on-board computing system 118 may be provided on other parts of the HMD 102 or may be positioned remote from the HMD 102 (e.g., the on-board computing system 118 could be wire- or wirelessly-connected to the HMD 102). The on-board computing system 118 may include a processor and memory, for example. The on-board computing system 118 may be configured to receive and analyze data from the image capture device 120 and the finger-operable touch pad 124 (and possibly from other sensory devices, user interfaces, or both) and generate images for output by the lens elements 110 and 112.

The image capture device 120 may be, for example, a camera that is configured to capture still images and/or to capture video. In the illustrated configuration, image capture device 120 is positioned on the extending side-arm 114 of the HMD 102; however, the image capture device 120 may be provided on other parts of the HMD 102. The image capture device 120 may be configured to capture images at various resolutions or at different frame rates. Many image capture devices with a small form-factor, such as the cameras used in mobile phones or webcams, for example, may be incorporated into an example of the HMD 102.

Further, although FIG. 1A illustrates one image capture device 120, more image capture device may be used, and each may be configured to capture the same view, or to capture different views. For example, the image capture device 120 may be forward facing to capture at least a portion of the real-world view perceived by the user. This forward facing image captured by the image capture device 120 may then be used to generate an augmented reality where computer generated images appear to interact with or overlay the real-world view perceived by the user.

The sensor 122 is shown on the extending side-arm 116 of the HMD 102; however, the sensor 122 may be positioned on other parts of the HMD 102. For illustrative purposes, only one sensor 122 is shown. However, in an example embodiment, the HMD 102 may include multiple sensors. For example, an HMD 102 may include sensors 102 such as one or more gyroscopes, one or more accelerometers, one or more magnetometers, one or more light sensors, one or more infrared sensors, and/or one or more microphones. Other sensing devices may be included in addition or in the alternative to the sensors that are specifically identified herein.

The finger-operable touch pad 124 is shown on the extending side-arm 114 of the HMD 102. However, the finger-operable touch pad 124 may be positioned on other parts of the HMD 102. Also, more than one finger-operable touch pad may be present on the HMD 102. The finger-operable touch pad 124 may be used by a user to input commands. The finger-operable touch pad 124 may sense at least one of a pressure, position and/or a movement of one or more fingers via capacitive sensing, resistance sensing, or a surface acoustic wave process, among other possibilities. The finger-operable touch pad 124 may be capable of sensing movement of one or more fingers simultaneously, in addition to sensing movement in a direction parallel or planar to the pad surface, in a direction normal to the pad surface, or both, and may also be capable of sensing a level of pressure applied to the touch pad surface. In some embodiments, the finger-operable touch pad 124 may be formed of one or more translucent or transparent insulating layers and one or more translucent or transparent conducting layers. Edges of the finger-operable touch pad 124 may be formed to have a raised, indented, or roughened surface, so as to provide tactile feedback to a user when the user's finger reaches the edge, or other area, of the finger-operable touch pad 124. If more than one finger-operable touch pad is present, each finger-operable touch pad may be operated independently, and may provide a different function.

In a further aspect, HMD 102 may be configured to receive user input in various ways, in addition or in the alternative to user input received via finger-operable touch pad 124. For example, on-board computing system 118 may implement a speech-to-text process and utilize a syntax that maps certain spoken commands to certain actions. In addition, HMD 102 may include one or more microphones via which a wearer's speech may be captured. Configured as such, HMD 102 may be operable to detect spoken commands and carry out various computing functions that correspond to the spoken commands.

As another example, HMD 102 may interpret certain head-movements as user input. For example, when HMD 102 is worn, HMD 102 may use one or more gyroscopes and/or one or more accelerometers to detect head movement. The HMD 102 may then interpret certain head-movements as being user input, such as nodding, or looking up, down, left, or right. An HMD 102 could also pan or scroll through graphics in a display according to movement. Other types of actions may also be mapped to head movement.

As yet another example, HMD 102 may interpret certain gestures (e.g., by a wearer's hand or hands) as user input. For example, HMD 102 may capture hand movements by analyzing image data from image capture device 120, and initiate actions that are defined as corresponding to certain hand movements.

As a further example, HMD 102 may interpret eye movement as user input. In particular, HMD 102 may include one or more inward-facing image capture devices and/or one or more other inward-facing sensors (not shown) that may be used to track eye movements and/or determine the direction of a wearer's gaze. As such, certain eye movements may be mapped to certain actions. For example, certain actions may be defined as corresponding to movement of the eye in a certain direction, a blink, and/or a wink, among other possibilities.

HMD 102 also includes a speaker 125 for generating audio output. In one example, the speaker could be in the form of a BCT. Speaker 125 may be, for example, a vibration transducer or an electroacoustic transducer that produces sound in response to an electrical audio signal input. The frame of HMD 102 may be designed such that when a user wears HMD 102, the speaker 125 contacts the wearer. Alternatively, speaker 125 may be embedded within the frame of HMD 102 and positioned such that, when the HMD 102 is worn, speaker 125 vibrates a portion of the frame that contacts the wearer. In either case, HMD 102 may be configured to send an audio signal to speaker 125, so that vibration of the speaker may be directly or indirectly transferred to the bone structure of the wearer. When the vibrations travel through the bone structure to the bones in the middle ear of the wearer, the wearer can interpret the vibrations provided by BCT 125 as sounds.

Various types of bone-conduction transducers (BCTs) may be implemented, depending upon the particular implementation. Generally, any component that is arranged to vibrate the HMD 102 may be incorporated as a vibration transducer. Yet further it should be understood that an HMD 102 may include a single speaker 125 or multiple speakers. In addition, the location(s) of speaker(s) on the HMD may vary, depending upon the implementation. For example, a speaker may be located proximate to a wearer's temple (as shown), behind the wearer's ear, proximate to the wearer's nose, and/or at any other location where the speaker 125 can vibrate the wearer's bone structure.

Figure 1B:
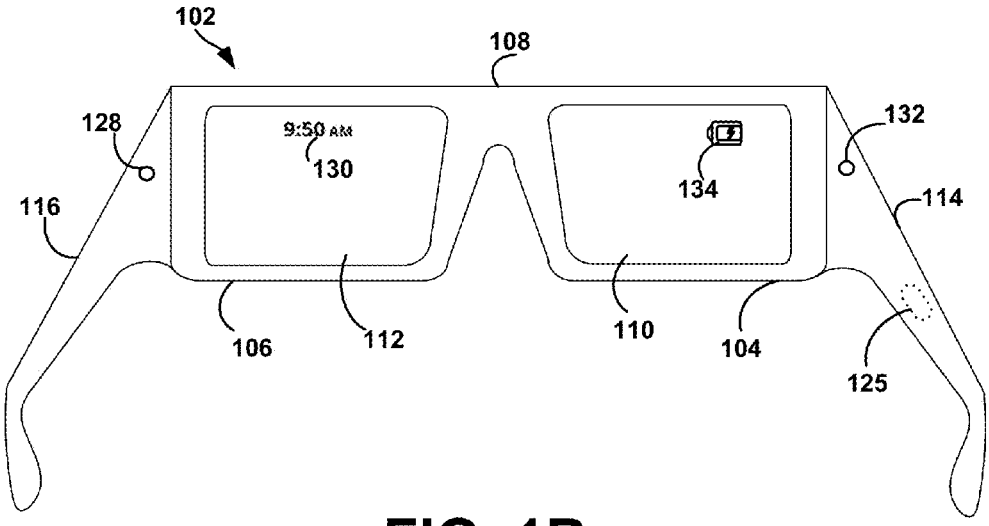
FIG. 1B illustrates an alternate view of the wearable computing device illustrated in FIG. 1A.

FIG. 1B illustrates an alternate view of the wearable computing device illustrated in FIG. 1A. As shown in FIG. 1B, the lens elements 110, 112 may act as display elements. The HMD 102 may include a first projector 128 coupled to an inside surface of the extending side-arm 116 and configured to project a display 130 onto an inside surface of the lens element 112. Additionally or alternatively, a second projector 132 may be coupled to an inside surface of the extending side-arm 114 and configured to project a display 134 onto an inside surface of the lens element 110.

The lens elements 110, 112 may act as a combiner in a light projection system and may include a coating that reflects the light projected onto them from the projectors 128, 132. In some embodiments, a reflective coating may not be used (e.g., when the projectors 128, 132 are scanning laser devices).

In alternative embodiments, other types of display elements may also be used. For example, the lens elements 110, 112 themselves may include: a transparent or semi-transparent matrix display, such as an electroluminescent display or a liquid crystal display, one or more waveguides for delivering an image to the user's eyes, or other optical elements capable of delivering an in focus near-to-eye image to the user. A corresponding display driver may be disposed within the frame elements 104, 106 for driving such a matrix display. Alternatively or additionally, a laser or LED source and scanning system could be used to draw a raster display directly onto the retina of one or more of the user's eyes. Other possibilities exist as well.

Figure 1C:
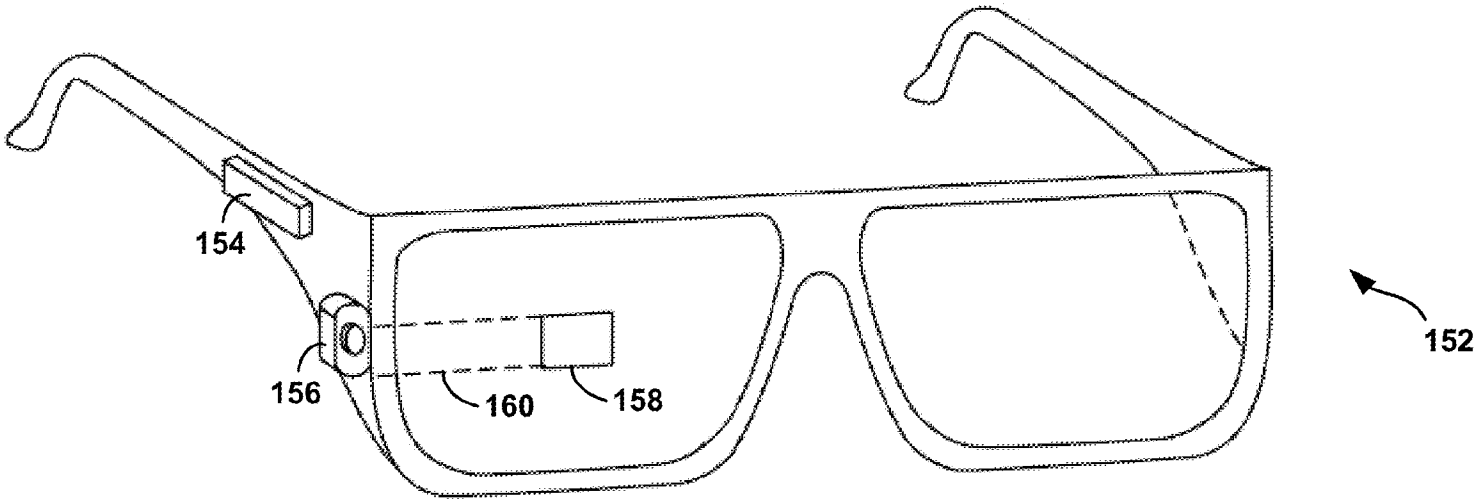
FIG. 1C illustrates another wearable computing system according to an example embodiment.

FIG. 1C illustrates another wearable computing system according to an example embodiment, which takes the form of an HMD 152. The HMD 152 may include frame elements and side-arms such as those described with respect to FIGS. 1A and 1B. The HMD 152 may additionally include an on-board computing system 154 and an image capture device 156, such as those described with respect to FIGS. 1A and 1B. The image capture device 156 is shown mounted on a frame of the HMD 152. However, the image capture device 156 may be mounted at other positions as well.

As shown in FIG. 1C, the HMD 152 may include a single display 158 which may be coupled to the device. The display 158 may be formed on one of the lens elements of the HMD 152, such as a lens element described with respect to FIGS. 1A and 1B, and may be configured to overlay computer-generated graphics in the user's view of the physical world. The display 158 is shown to be provided in a center of a lens of the HMD 152, however, the display 158 may be provided in other positions, such as for example towards either the upper or lower portions of the wearer's field of view. The display 158 is controllable via the computing system 154 that is coupled to the display 158 via an optical waveguide 160.

Figure 1D:
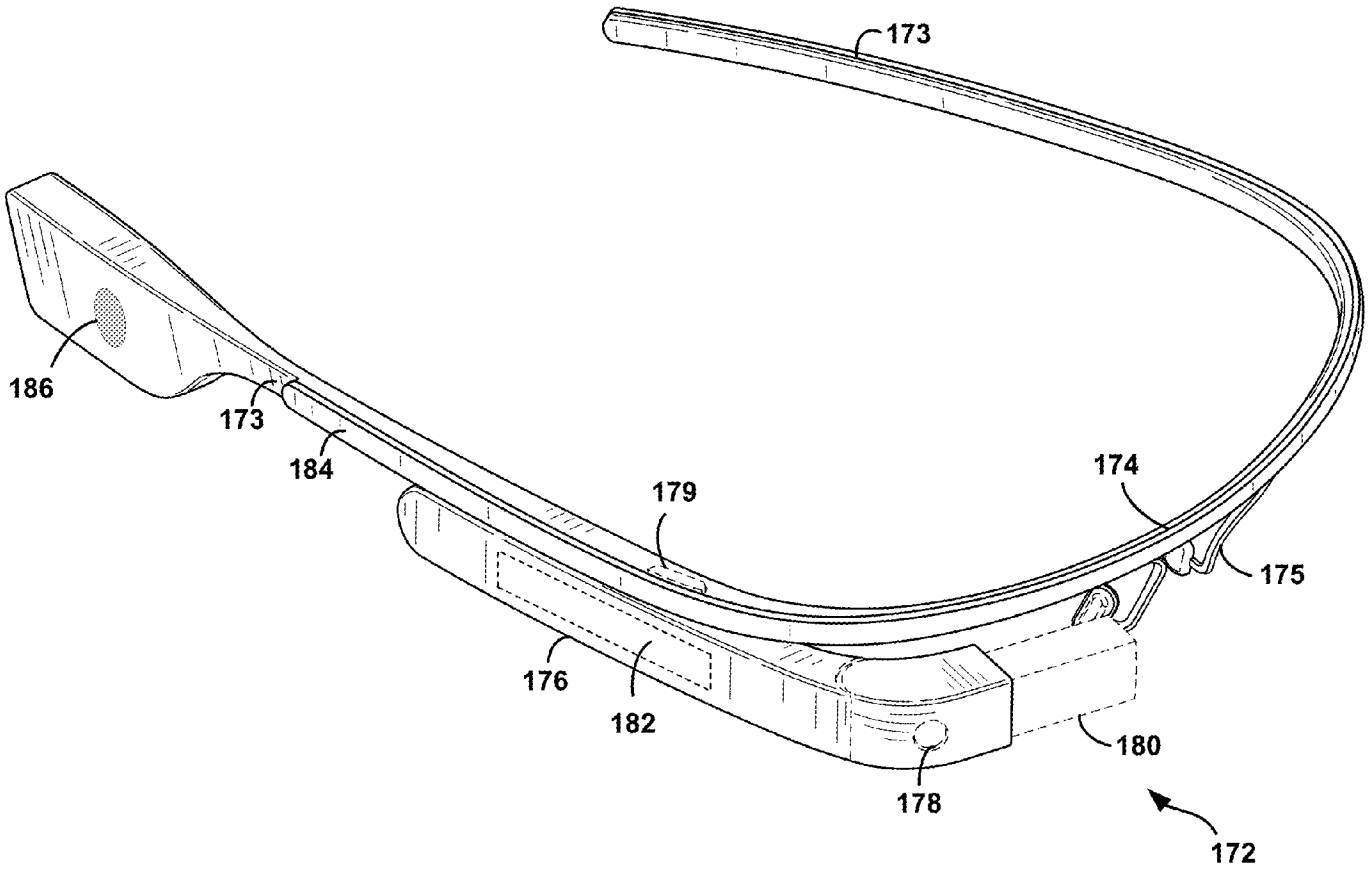
FIG. 1D illustrates another wearable computing system according to an example embodiment.

FIG. 1D illustrates another wearable computing system according to an example embodiment, which takes the form of a monocular HMD 172. The HMD 172 may include side-arms 173, a center frame support 174, and a bridge portion with nosepiece 175. In the example shown in FIG. 1D, the center frame support 174 connects the side-arms 173. The HMD 172 does not include lens-frames containing lens elements. The HMD 172 may additionally include a component housing 176, which may include an on-board computing system (not shown), an image capture device 178, and a button 179 for operating the image capture device 178 (and/or usable for other purposes). Component housing 176 may also include other electrical components and/or may be electrically connected to electrical components at other locations within or on the HMD. HMD 172 also includes a BCT 186.

The HMD 172 may include a single display 180, which may be coupled to one of the side-arms 173 via the component housing 176. In an example embodiment, the display 180 may be a see-through display, which is made of glass and/or another transparent or translucent material, such that the wearer can see their environment through the display 180. Further, the component housing 176 may include the light sources (not shown) for the display 180 and/or optical elements (not shown) to direct light from the light sources to the display 180. As such, display 180 may include optical features that direct light that is generated by such light sources towards the wearer's eye, when HMD 172 is being worn.

In a further aspect, HMD 172 may include a sliding feature 184, which may be used to adjust the length of the side-arms 173. Thus, sliding feature 184 may be used to adjust the fit of HMD 172. Further, an HMD may include other features that allow a wearer to adjust the fit of the HMD, without departing from the scope of the invention.

Figure 1E:
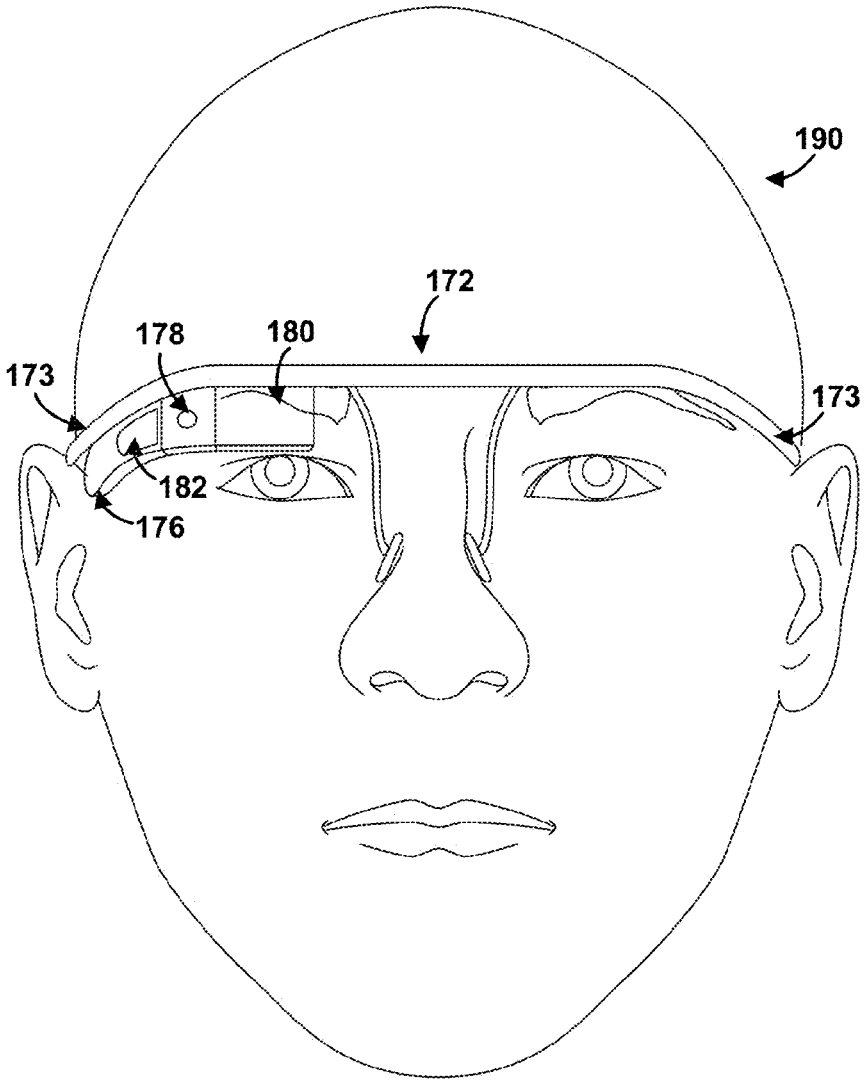
FIGS. 1E to 1G are simplified illustrations of the wearable computing system shown in FIG. 1D, being worn by a wearer.
Figure 1F:
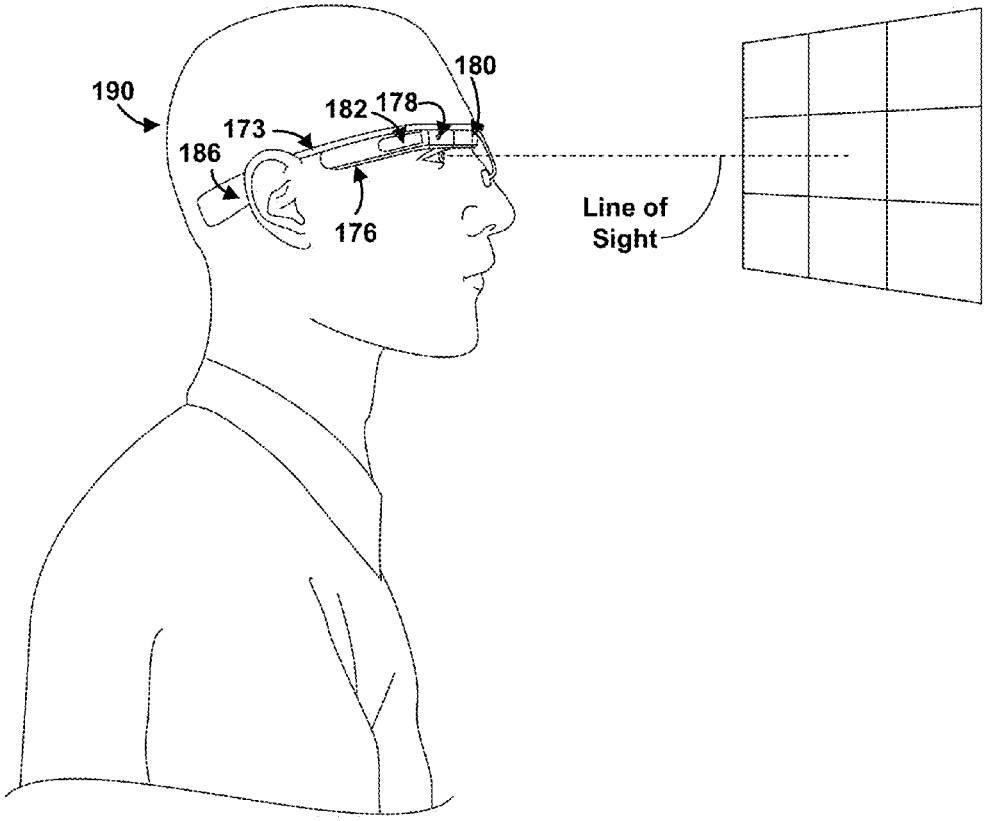
Figure 1G:
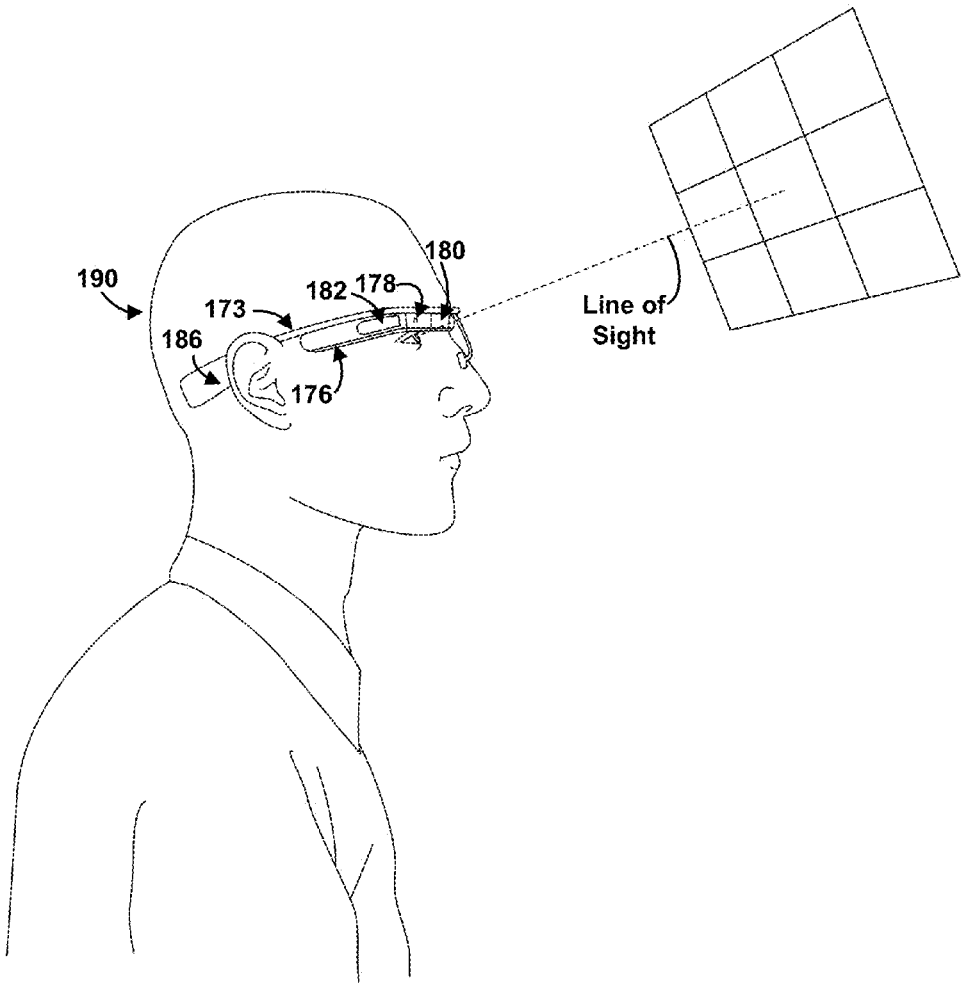

FIGS. 1E to 1G are simplified illustrations of the HMD 172 shown in FIG. 1D, being worn by a wearer 190. As shown in FIG. 1F, when HMD 172 is worn, BCT 186 is arranged such that when HMD 172 is worn, BCT 186 is located behind the wearer's ear. As such, BCT 186 is not visible from the perspective shown in FIG. 1E.

In the illustrated example, the display 180 may be arranged such that when HMD 172 is worn, display 180 is positioned in front of or proximate to a user's eye when the HMD 172 is worn by a user. For example, display 180 may be positioned below the center frame support and above the center of the wearer's eye, as shown in FIG. 1E. Further, in the illustrated configuration, display 180 may be offset from the center of the wearer's eye (e.g., so that the center of display 180 is positioned to the right and above of the center of the wearer's eye, from the wearer's perspective).

Configured as shown in FIGS. 1E to 1G, display 180 may be located in the periphery of the field of view of the wearer 190, when HMD 172 is worn. Thus, as shown by FIG. 1F, when the wearer 190 looks forward, the wearer 190 may see the display 180 with their peripheral vision. As a result, display 180 may be outside the central portion of the wearer's field of view when their eye is facing forward, as it commonly is for many day-to-day activities. Such positioning can facilitate unobstructed eye-to-eye conversations with others, as well as generally providing unobstructed viewing and perception of the world within the central portion of the wearer's field of view. Further, when the display 180 is located as shown, the wearer 190 may view the display 180 by, e.g., looking up with their eyes only (possibly without moving their head). This is illustrated as shown in FIG. 1G, where the wearer has moved their eyes to look up and align their line of sight with display 180. A wearer might also use the display by tilting their head down and aligning their eye with the display 180.

Figure 2:
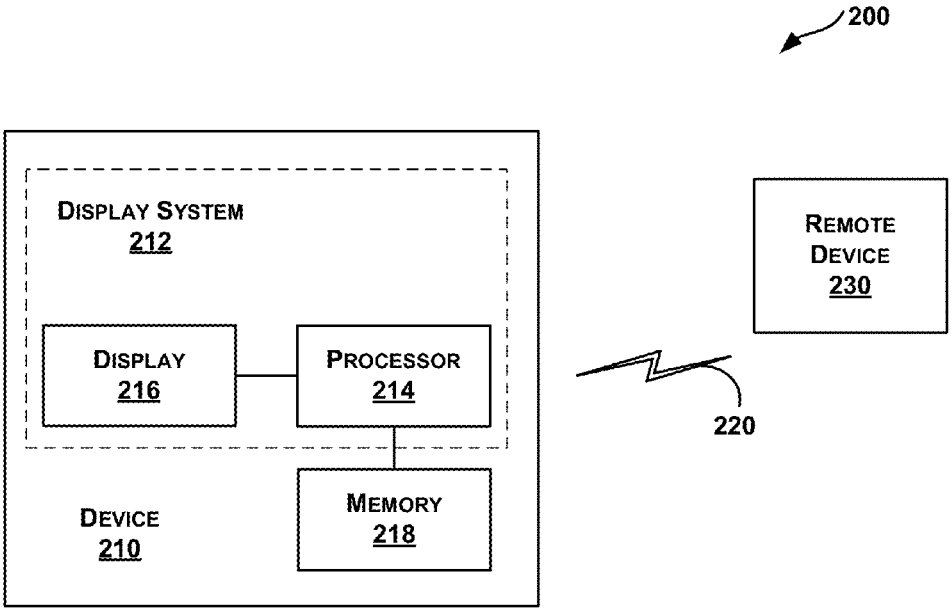
FIG. 2 illustrates a schematic drawing of a computing device, according to an example embodiment.

FIG. 2 illustrates a schematic drawing of a computing device 210 according to an example embodiment. In an example embodiment, device 210 communicates using a communication link 220 (e.g., a wired or wireless connection) to a remote device 230. The device 210 may be any type of device that can receive data and display information corresponding to or associated with the data. For example, the device 210 may be a heads-up display system, such as the head-mounted devices 102, 152, or 172 described with reference to FIGS. 1A to 1G.

Thus, the device 210 may include a display system 212 comprising a processor 214 and a display 216. The display 210 may be, for example, an optical see-through display, an optical see-around display, or a video see-through display. The processor 214 may receive data from the remote device 230, and configure the data for display on the display 216. The processor 214 may be any type of processor, such as a microprocessor or a digital signal processor, for example.

The device 210 may further include on-board data storage, such as memory 218 coupled to the processor 214. The memory 218 may store software that can be accessed and executed by the processor 214, for example.

The remote device 230 may be any type of computing device or transmitter including a laptop computer, a mobile telephone, or tablet computing device, etc., that is configured to transmit data to the device 210. The remote device 230 and the device 210 may contain hardware to enable the communication link 220, such as processors, transmitters, receivers, antennas, etc.

Further, remote device 230 may take the form of or be implemented in a computing system that is in communication with and configured to perform functions on behalf of client device, such as computing device 210. Such a remote device 230 may receive data from another computing device 210 (e.g., an HMD 102, 152, or 172 or a mobile phone), perform certain processing functions on behalf of the device 210, and then send the resulting data back to device 210. This functionality may be referred to as a "cloud" computing.

In FIG. 2, the communication link 220 is illustrated as a wireless connection; however, wired connections may also be used. For example, the communication link 220 may be a wired serial bus such as a universal serial bus or a parallel bus. A wired connection may be a proprietary connection as well. The communication link 220 may also be a wireless connection using, e.g., Bluetooth® radio technology, communication protocols described in IEEE 802.11 (including any IEEE 802.11 revisions), Cellular technology (such as GSM, CDMA, UMTS, EV-DO, WiMAX, or LTE), or Zigbee® technology, among other possibilities. The remote device 230 may be accessible via the Internet and may include a computing cluster associated with a particular web service (e.g., social-networking, photo sharing, address book, etc.).

Example Bone Conducting Transducers

Figure 3:
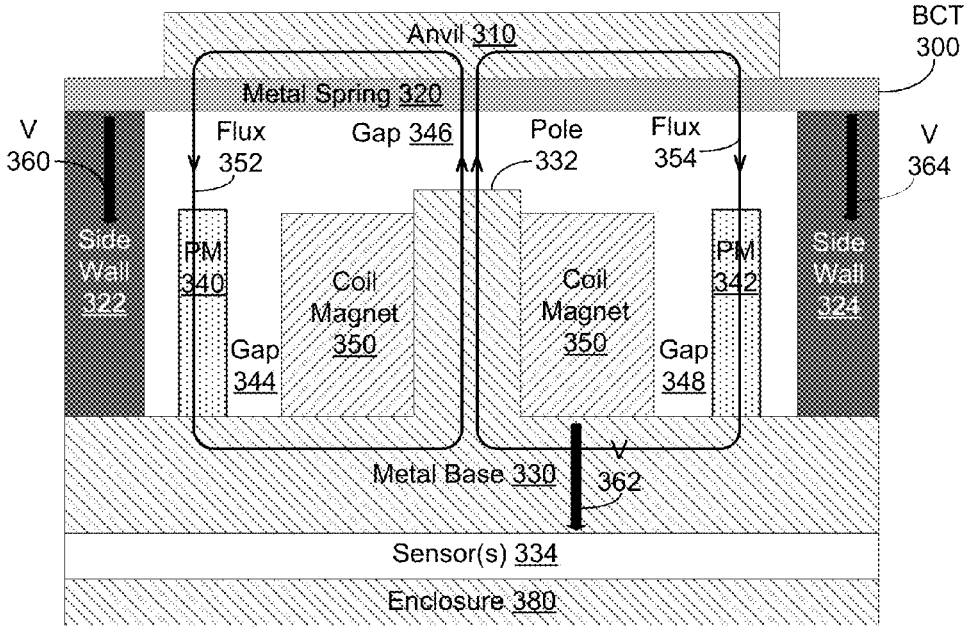
FIG. 3 is a cutaway view of an example bone conducting transceiver (BCT), according to an example embodiment.

FIG. 3 is a cutaway view of BCT 300, according to an example embodiment. BCT 300 includes a metal base 330 configured with pole 332 that supports coil magnet 350 and permanent magnets (PMs) 340, 342 configured to be separated by respective gaps 344, 348 from coil magnet 350. Base 330 also supports sidewalls 316, 318, each of which in turn support metal spring 320. Anvil 310 rests on a top surface of metal spring 320. BCT 300 can be surrounded by enclosure 380 (partially shown in FIG. 3).

Measurements of BCT 300 can be taken by sensor(s) 334. FIG. 3 shows sensor(s) 334 inside BCT 300 between base 330 and enclosure 380. In some embodiments, some or all of sensor(s) 334 inside BCT 300 can be located in other portions of BCT 300; e.g., embedded in base 330 and/or enclosure 380. In other embodiments, some or all of sensor(s) 334 can be outside of BCT 300; in these embodiments, BCT 300 can include contacts, connections and/or other access points for the external sensor(s). In still other embodiments, sensors 334 can include sensors that are located both inside and outside BCT 300.

In response to signals provided to coil magnet 350, alternating magnetic fields, shown in FIG. 3 as fluxes 352, 354, can be generated in anvil 310, coil magnet 350, and permanent magnets 340, 342. The signals can be provided to coil magnet 350 using a wire or other conductor (not shown in FIG. 3) that can be connected to coil magnet 350. The signals (or the wire) can be said to drive coil magnet 350 as the signals in the wire can be alternating electrical signals that, when received at coil magnet 350, cause generation of alternating magnetic fields in coil magnet 350.

These alternating magnetic fields can induce vibrations in anvil 310 and metal spring 320 can provide a force to anvil 320 to restore anvil 310 to an equilibrium state after vibrating. In some embodiments, BCT 300 can be configured as part of a device, such as a HMD, so that a portion of BCT 300 (e.g., anvil 310) comes in contact with one or more bones of a user or wearer of the device. If contact with a bone of a user or wearer, such as a skull, the vibrations can pass from BCT 300 through bone(s) of the user or wearer to reach the directly stimulate the ossicles and thus lead to sound perception.

The signals that drive coil magnet 350 of BCT 300 can be modified based on the measured characteristics of BCT 300. For example, data about characteristics of BCT 300 can be provided to a computing device. The computing device can use the received data to determine and/or modify characteristics, such as gain, of the signals that drive coil magnet 350.

The data about characteristics of BCT 300 can be generated by sensor(s) 334. Sensor(s) 334 can include, but are not limited to, current, voltage, impedance, capacitance, and resistance sensors configured to respectively measure current, voltage, impedance, capacitance, and resistance characteristics of BCT 300, force and pressure sensors configured to respectively measure force(s) acting on BCT 300 and pressure on BCT 300, and proximity sensors configured to determine whether BCT 300 was near (proximate) to another object. These data can provide information about an environment in which BCT 300 is being used; e.g., whether BCT 300 is contacting a surface, electrical characteristics of BCT 300, and/or information about objects touching and/or near to BCT 300.

In some embodiments, one or both of sidewalls 322, 324 can be made of rubber or other sound-absorbing material that can deaden, dampen, absorb, block, and/or otherwise reduce or stop vibrations from being emitted through sidewalls 322, 324 or base 330, and thus reduce or eliminate sound leakage from BCT 300. FIG. 3 shows vibrations (V) 360, 362, and 364 that can lead to sound leakage. If sidewall 322 is made of a sound-absorbing material; e.g. rubber, then sidewall 322 can reduce or eliminate vibrations 360. Similarly, if sidewall 324 is made of a sound-absorbing material; e.g. rubber, then sidewall 316 can reduce or eliminate vibrations 364.

Figure 4A:
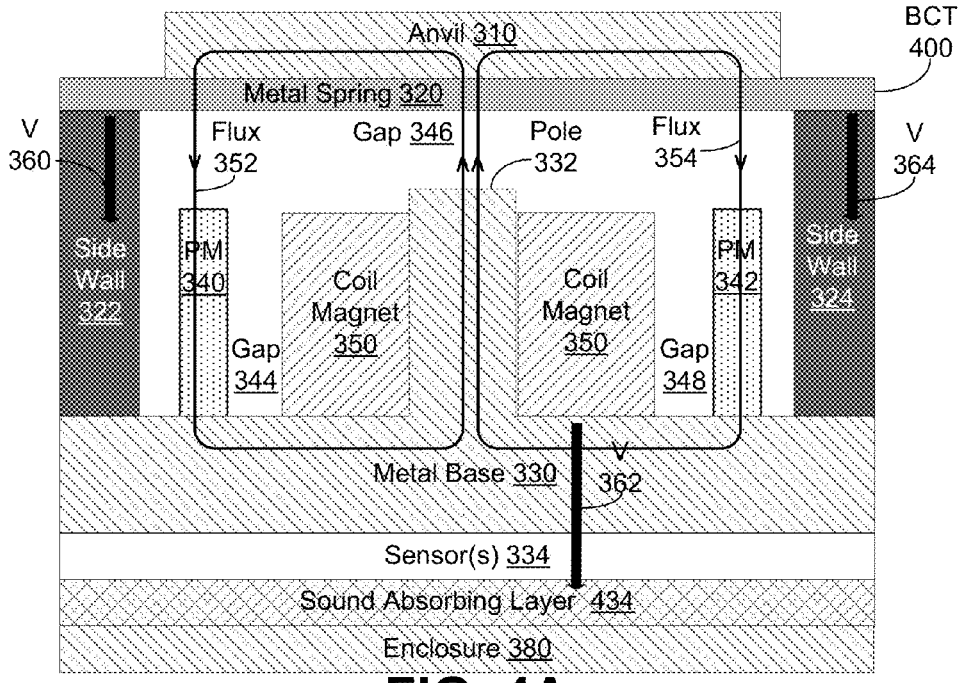
FIG. 4A is a cutaway view of another example BCT, according to an example embodiment.

FIG. 4A is a cutaway view of BCT 400, according to an example embodiment. BCT 400 includes the above-discussed components of BCT 300 and further includes sound absorbing layer 434 between based 330 and enclosure 380. Sound absorbing layer 434 can include one or more foams and/or sound-absorbing materials; e.g., rubber, acoustic foam, sound-absorbing foam, conductive foam, a force sensing foam (FSF), and/or some other type of foam and/or sound-absorbing material. Sound absorbing layer 434 can be configured to reduce or prevent vibrations, such as vibrations (V) 362 emitted from base 330, from reaching enclosure 380 thereby reducing or perhaps eliminating sound leakage from base 330 to enclosure 380.

In some embodiments, sensor(s) 334 can be placed in sound absorbing layer 434. In these embodiments, a lower surface of base 330 can be in contact with an upper surface of foam/sound damping layer 434 with sensor(s) embedded or otherwise in sound absorbing layer 434. The embedded sensor(s) can generate data about characteristics of BCT 400, such as discussed above in the context of sensor(s) 334 of BCT 300 and FIG. 3. A lower surface of sound absorbing layer 434 can be in contact with an upper surface of enclosure 380. As sound absorbing layer is interposed between base 330 and enclosure 380, vibrations 362 can be reduced or eliminated while traveling from base 300 through sound absorbing layer 434, and then reduce leakage due to vibrations 464 reaching and consequently vibrating enclosure 380.

Figure 4B:
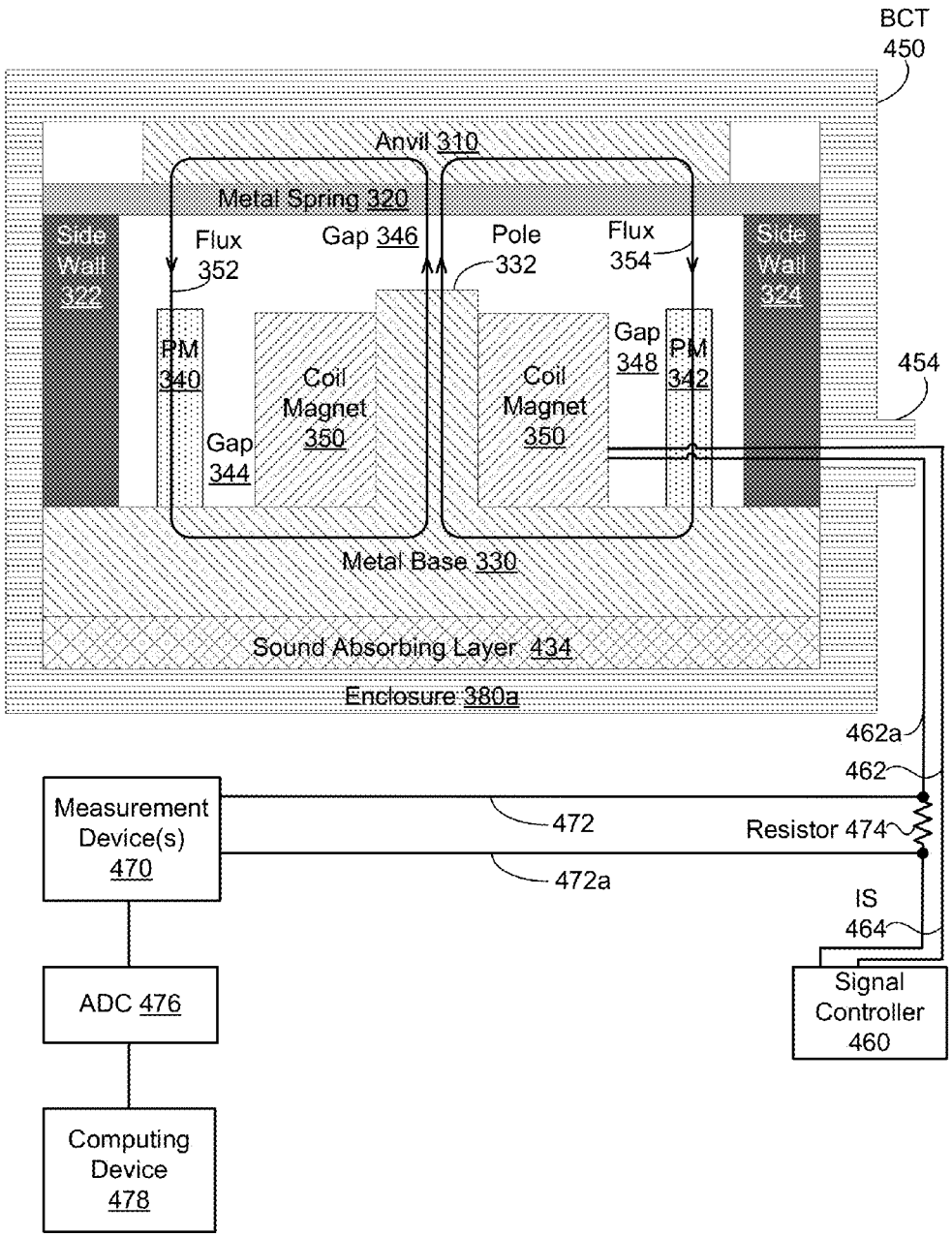
FIG. 4B is a cutaway view of another example BCT with external sensor(s), according to an example embodiment.

FIG. 4B is a cutaway view of BCT 450 with measurement device(s) 470, according to an example embodiment. BCT 450 includes the above-discussed components of BCT 400, with enclosure 380*a* shown surrounding components of BCT 450. Enclosure 380*a* includes aperture 454 to permit entry of wires 462, 462*a*. Wire 462 can be configured to carry input signals (IS) 464 from signal controller 460 to coil magnet 350, and wire 462*a* can complete a circuit to signal controller 460.

Input signals 464 can change magnetic fields generated by coil magnet 350 and thus change to flux 354. Changes in flux 354 can induce vibrations in metal spring 320 and anvil 310. These changes in vibration can be sensed by a wearer of BCT 450 as changes in sound. Signal controller 460 can be a radio, a player of recorded music or other sound (e.g., MP3 player, CD/DVD player, etc.), frequency generator, musical instrument, and/or other device; e.g., test equipment. In some embodiments, BCT 300 and/or BCT 400 can placed inside of enclosure 380*a* and be controlled by input signals 464 carried by wires 462, 462*a* to respective coil magnets 350. In other embodiments, herein-described functionality of signal controller 460 and computing device 478 can be provided by a single device; e.g., signal controller 460 can be configured to perform the herein-described functionality of computing device 478 or vice versa.

Unlike BCT 300 and BCT 400, BCT 450 does not include sensor(s) within enclosure 380*a*. Rather, resistor 474 is placed in series with coil magnet 350. In some embodiments, resistor 474 can have a relatively-small resistance; e.g., 0.1 ohm. Wires 472, 472*a* can establish a parallel circuit to measurement devices(s) 470 outside of BCT 450.

Measurement devices(s) 470 can include voltage, current, and/or resistance sensors configure to measure electrical characteristics, such as impedance, in a circuit between signal controller 460 and coil magnet 350. In particular embodiments, measurement device(s) 470 can include a voltmeter, or similar device, to measure a voltage drop across resistor 474 using wires 472, 472*a*.

For example, let the circuit between signal controller 460 and coil magnet 350 operate at a pre-determined voltage V1, let resistor 474 have a pre-determined resistance R1, and measurement devices(s) 470 be configured to measure at least a voltage drop $V_{meas}$ across resistor 474 via wires 472, 472*a*. Then, using Ohm's law:

$$I_{meas}=V_{meas}/R1 \quad (1)$$

An impedance Z generated by magnetic fields in BCT 450 is $$Z=(V1-V_{meas})/I_{meas} \quad (2)$$

In some embodiments, measurement devices(s) 470 can determine or receive measured voltage value(s) $V_{meas}$ across resistor 474, and provide the measured voltage value(s) $V_{meas}$ to ADC 476. In other embodiments, measurement devices(s) 470 can determine or receive measured voltage value(s) $V_{meas}$, use equation (1) to determine measured current value(s) $I_{meas}$, and then use equation (2) with known voltage V1 to determine and provide value(s) for impedance Z generated by magnetic fields in BCT 450.

In some embodiments, outputs of measurement devices(s) 470, such as $V_{meas}$ and/or Z values, are in analog format. In these embodiments, analog-to-digital converter (ADC) 476 can receive the analog-formatted output values of measurement device(s) 470 and transmit corresponding digital-formatted output values. In other embodiments, measurement devices(s) 470 can generate digital-formatted output values directly, and in these embodiments, ADC 476 may not be present.

The digital-formatted output values can be provided to a computing device, such as computing device 478. In some embodiments, computing device 478 can receive digital-formatted output values including measured voltage value(s) $V_{meas}$ from measurement devices(s) 470 or ADC 476 and use equations (1) and (2) as discussed above to determine corresponding impedance value(s) Z. In other embodiments, computing device 478 can receive digital-formatted output values including impedance value(s) Z from measurement devices(s) 470 or ADC 476.

Data Regarding Measured Characteristics of BCTs

Figure 5:
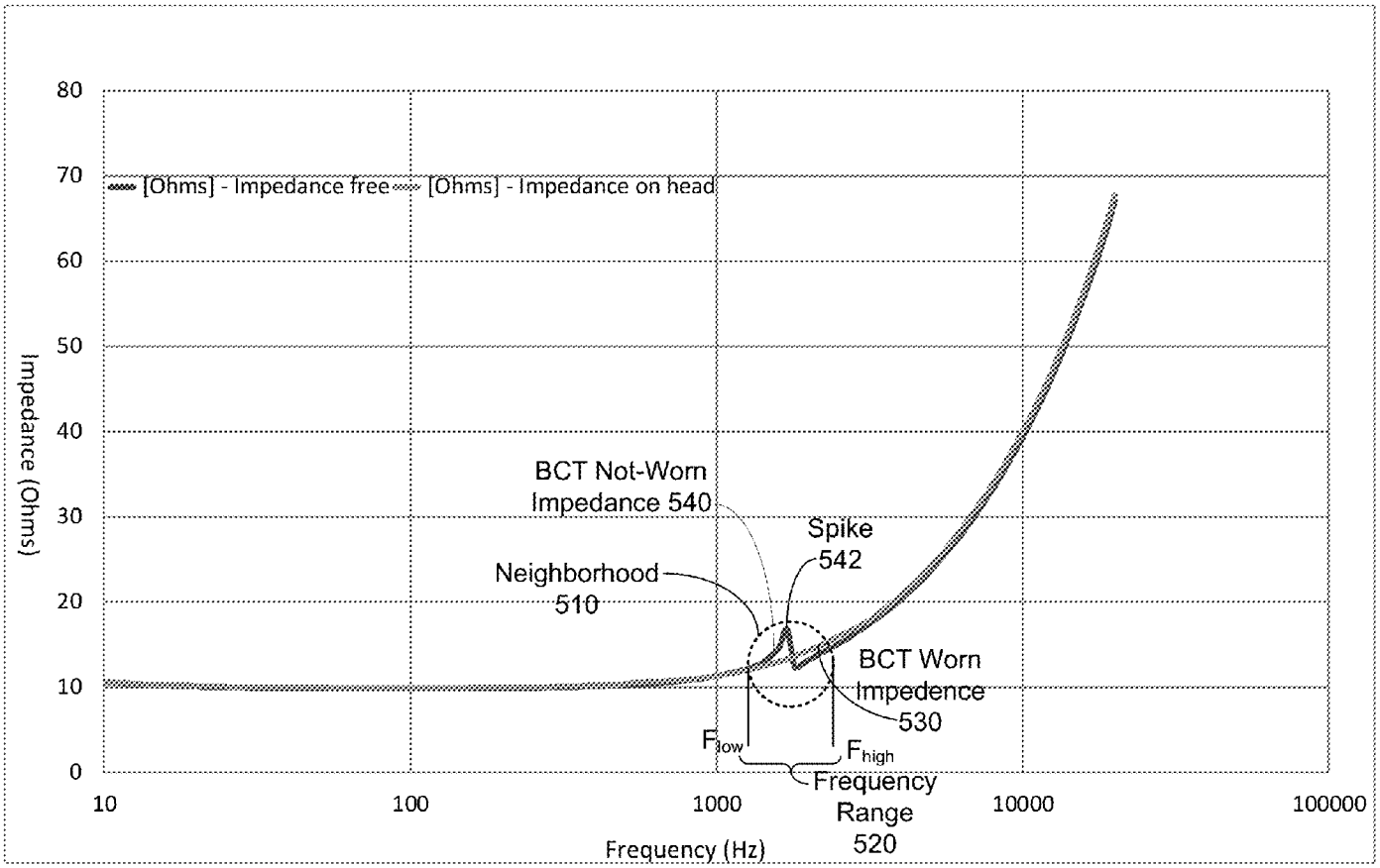
FIG. 5 is a graph of impedance as a function of frequency for (i) a BCT being worn and (ii) a BCT not being worn, according to an example embodiment.

FIG. 5 is a graph 500 of impedance as a function of frequency for (i) a BCT, such as BCT 300 or BCT 400, being worn and (ii) the BCT not being worn, according to an example embodiment. In graph 500, two lines are shown: a lighter-grey line which shows impedance as a function of frequency when the BCT is being worn ("on head" as indicated in the legend of graph 500), and darker-grey line shows impedance as a function of frequency when the BCT is not being worn ("free" as indicated in the legend of graph 500).

FIG. 5 shows a neighborhood 510 of graph 500, where neighborhood 510 is based on frequency range 520 from frequency $F_{low}$ of approximately 1250 Hz to $F_{high}$ of approximately 2250 Hz. Within neighborhood 510, the impedance of the BCT when the BCT is worn 530 forms a smooth, monotonically increasing curve. Also within neighborhood 510, the impedance of the BCT when the BCT is not worn 540 rapidly increases until the frequency reaches approximately 1700 Hz, shown in FIG. 5 as spike 542, and then rapidly decreases at approximately 1800 Hz to be less than BCT worn impedance 530.

Spike 542 may be caused by a BCT operating at a resonant frequency of the metal spring, causing impedance across the BCT to be relatively high at the resonant frequency and diminish for frequencies less than or greater than the resonant frequency. When worn, the metal spring comes in contact with part of a body of the wearer or other surface such as a baseball hat, clothing, etc., perhaps via an anvil such as anvil 310. With the BCT in contact with the wearer's body (or other surface), movement of the metal spring is damped at the resonant frequency, and the impedance across the BCT may not spike when the BCT is worn.

One or more sensors, such as sensor(s) 334 of BCT 300 or BCT 400 or resistor 474 for BCT 450, can be configured to provide impedance data within one or more frequency ranges, such as the range $F_{low}$ to $F_{high}$ shown in FIG. 5. The impedance data can be provided to a device, such as a computing device, that provides a signal that drives the BCT and then adjust one or more characteristics of the signal based on the impedance data. For example, the computing device can detect characteristics of the impedance data, such as spike 542.

Upon detecting these characteristics of the impedance data, the computing device can adjust the one or more characteristics of the signal. For example, upon detecting a spike in the impedance data between $F_{low}$ to $F_{high}$, the computing device can determine that the BCT is likely not being worn. As such, the computing device can decrease a gain of the signal that drives the BCT which can reduce vibrations emitted by the BCT. In some cases, the computing device set the gain level to 0 and so turn the signal off; e.g., if the computing device detects the spike(s) within a predetermined frequency range, and thus determines the BCT is not being worn, over a period of time that exceeds a predetermined threshold, such as several seconds or minutes.

As another example, if the computing device detects that the impedance data between $F_{low}$ to $F_{high}$ is monotonically increasing, the computing device can determine that the BCT is likely being worn. As such, the computing device can increase the gain of the signal that drives the BCT, which can increase the volume of sound, as perceived by the wearer, produced by the BCT driven by the signal.

As another example, if the computing device detects that the impedance data between $F_{low}$ to $F_{high}$ is not monotonically increasing, the computing device can determine that the computing device is not likely being worn. As such, the computing device can shut down the power to the display or other circuitry to conserve power; e.g., battery power.

Example Operations

Figure 6:
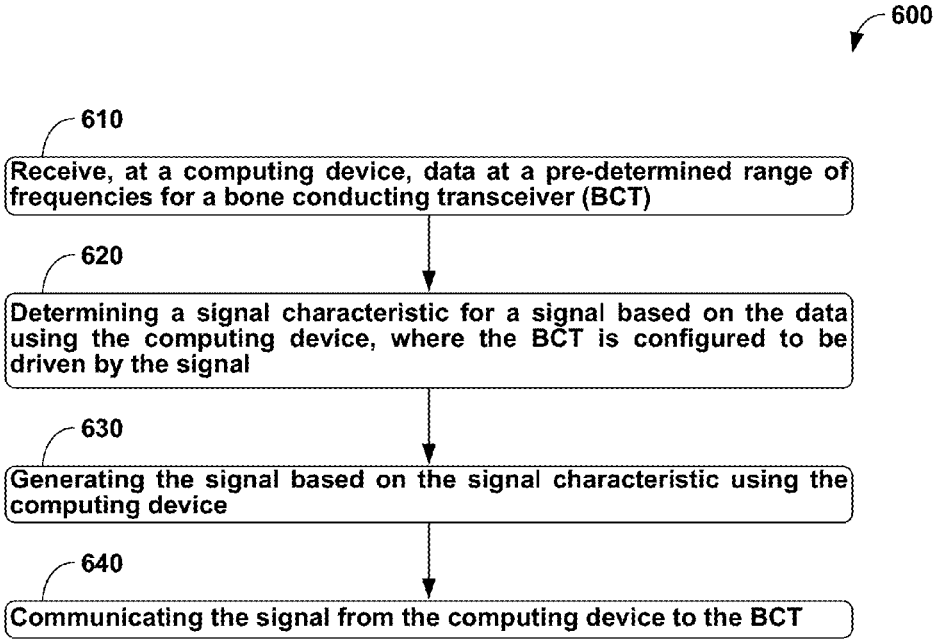
FIG. 6 is a flow chart illustrating a method, according to an example embodiment.

FIG. 6 is a flow chart illustrating method 600, according to an example embodiment. Method 600 is described by way of example as being carried out by a computing device, such as one or more of the wearable computing devices described herein, but may be carried out by other devices or systems as well.

For example, method 600 can be performed by a device configured with a BCT described herein, such as but not limited to BCT 300, BCT 400, BCT 450, and a control system, such as signal controller 460. The control system can include a computing device, such as computing device 210 or computing device 478, configured with program logic, such as software, instructions, firmware, and/or hardware, for carrying out part or all of the method 600. In some embodiments, part or all of the computer logic can be stored on a non-transitory computer readable medium.

Method 600 can begin at block 610, where a computing device can receive data at a pre-determined range of frequencies for a BCT. In some embodiments, the data at the pre-determined range of frequencies can include impedance data; while in other embodiments, the data at the pre-determined range of frequencies can include measured voltage data.

At block 620, the computing device can determine a signal characteristic for a signal based on the data. The BCT can be configured to be driven by the signal. In some embodiments, the signal characteristic can be a gain of the signal.

In some embodiments, the data at the pre-determined range of frequencies includes impedance data and determining the signal characteristic for the signal based on the data can include: determining whether the impedance data includes a spike within the pre-determined range of frequencies; after determining that the impedance data includes the spike, setting the gain of the signal to a first gain level; and after determining that the impedance data does not include the spike, setting the gain of the signal to a second gain level, wherein the first gain level differs from the second gain level.

In particular embodiments, the first gain level can be less than the second gain level. In other embodiments, method 600 can further include: after determining that the impedance data includes the spike, determining that the BCT is not in contact with a surface; and after determining that the impedance data does not include the spike, determining that the BCT is in contact with the surface. In some of these other embodiments, the surface can include part of a body of a wearer of the BCT.

In even other embodiments, the data at the pre-determined range of frequencies can include impedance data, and determining the signal characteristic for the signal based on the data can include: determining whether the impedance data includes a spike within the pre-determined range of frequencies; and after determining that the impedance data does include the spike, deactivating one or more components of the computing device, thereby reducing power utilized by the computing device.

In some embodiments, the data at the pre-determined range of frequencies can include measured voltage data. In these embodiments, determining the signal characteristic for the signal based on the data can include: determining impedance data based on the measured voltage data; and determining the signal characteristic for the signal based on the impedance data.

At block 630, the computing device can generate the signal based on the signal characteristic.

At block 640, the computing device can communicate the signal to the BCT.

Conclusion

The above detailed description describes various features and functions of the disclosed systems, devices, and methods with reference to the accompanying figures. In the figures, similar symbols typically identify similar components, unless context dictates otherwise. The illustrative embodiments described in the detailed description, figures, and claims are not meant to be limiting. Other embodiments can be utilized, and other changes can be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

With respect to any or all of the ladder diagrams, scenarios, and flow charts in the figures and as discussed herein, each block and/or communication may represent a processing of information and/or a transmission of information in accordance with example embodiments. Alternative embodiments are included within the scope of these example embodiments. In these alternative embodiments, for example, functions described as blocks, transmissions, communications, requests, responses, and/or messages may be executed out of order from that shown or discussed, including substantially concurrent or in reverse order, depending on the functionality involved. Further, more or fewer blocks and/or functions may be used with any of the ladder diagrams, scenarios, and flow charts discussed herein, and these ladder diagrams, scenarios, and flow charts may be combined with one another, in part or in whole.

A block that represents a processing of information may correspond to circuitry that can be configured to perform the specific logical functions of a herein-described method or technique. Alternatively or additionally, a block that represents a processing of information may correspond to a module, a segment, or a portion of program code (including related data). The program code may include one or more instructions executable by a processor for implementing specific logical functions or actions in the method or technique. The program code and/or related data may be stored on any type of computer readable medium such as a storage device including a disk or hard drive or other storage medium.

Further, a computer readable medium may be a non-transitory computer readable media such as computer-readable media that stores data for short periods of time like register memory, processor cache, and random access memory (RAM). The computer readable media may be a non-transitory computer readable media that stores program code and/or data for longer periods of time, such as secondary or persistent long term storage, like read only memory (ROM), optical or magnetic disks, compact-disc read only memory (CD-ROM), for example. The computer readable media may also be any other volatile or non-volatile storage systems. A computer readable medium may be considered a computer readable storage medium, for example, or a tangible storage device.

Moreover, a block that represents one or more information transmissions may correspond to information transmissions between software and/or hardware modules in the same physical device. However, other information transmissions may be between software modules and/or hardware modules in different physical devices.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A bone conducting transceiver (BCT), comprising:

a metal spring having two ends;

an anvil, mounted on an upper surface of the metal spring and configured to move in conjunction with the metal spring based on an input signal;

a base, contacting a lower surface of the metal spring and supporting at least one end of the two ends of the metal spring; and at least one sensor, configured to generate data regarding at least one characteristic of the BCT, wherein the data comprises impedance data; and a signal controller configured to:

determine whether or not the impedance data includes a spike within a pre-determined range of frequencies;

if it is determined that the impedance data includes the spike, set a gain of the input signal to a first gain level; and otherwise, set the gain of the signal to a second gain level, wherein the first gain level differs from the second gain level.

2. The BCT of claim 1, wherein the pre-determined range of frequencies is related to a resonant frequency of the metal spring.

3. The BCT of claim 1, wherein the BCT is configured to be connected to a computing device, wherein the computing device is configured to determine whether the BCT is in contact with a surface based on data for the impedance of the BCT at the pre-determined range of frequencies.

4. The BCT of claim 1, further comprising a sound damping layer, wherein at least some of the sound damping layer is made of a sound insulating material.

5. The BCT of claim 4, wherein the sound damping layer comprises the at least one sensor.

6. The BCT of claim 1, wherein the base comprises a sidewall, and wherein at least the sidewall is made of a sound insulating material.

7. The BCT of claim 6, wherein the sound insulating material comprises rubber.

8. The BCT of claim 1, further comprising at least one magnet that is configured to generate a magnetic force to move the metal spring and anvil based on the input signal.

9. A method, comprising:

receiving, at a computing device, data at a pre-determined range of frequencies for a bone conducting transceiver (BCT);

determining a signal characteristic for a signal based on the data using the computing device, wherein at least part of the BCT is configured to vibrate based on the signal, wherein the signal characteristic comprises a gain of the signal;

wherein the data at a pre-determined range of frequencies comprises impedance data, wherein determining the signal characteristic for the signal based on the data comprises:

determining whether or not the impedance data includes a spike within the pre-determined range of frequencies;

if it is determined that the impedance data includes the spike, setting the gain of the signal to a first gain level; and otherwise, setting the gain of the signal to a second gain level, wherein the first gain level differs from the second gain level;

generating the signal based on the signal characteristic using the computing device; and communicating the signal from the computing device to the BCT.

10. The method of claim 9, wherein the first gain level is less than the second gain level.

11. The method of claim 9, wherein the data at the pre-determined range of frequencies comprises impedance data, and wherein determining the signal characteristic for the signal based on the data comprises:

determining whether the impedance data includes a spike within the pre-determined range of frequencies; and after determining that the impedance data does include the spike, deactivating one or more components of the computing device, thereby reducing power utilized by the computing device.

12. The method of claim 11, further comprising:

after determining that the impedance data does include the spike, determining that the BCT is in contact with the surface.

13. The method of claim 12, wherein the surface comprises part of a body of a wearer of the BCT.

14. The method of claim 9, wherein the data at the pre-determined range of frequencies comprises measured voltage data, and wherein determining the signal characteristic for the signal based on the data comprises:

determining impedance data based on the measured voltage data; and determining the signal characteristic for the signal based on the impedance data.

15. A computing device, comprising:

a processor; and a non-transitory computer-readable storage medium configured to store at least instructions thereon, wherein the instructions are configured to, upon execution by the processor, cause the computing device to perform functions comprising:

receiving data at a pre-determined range of frequencies for a bone conducting transceiver (BCT);

determining a signal characteristic for a signal based on the data, wherein at least part of the BCT is configured to vibrate based on the signal, wherein the signal characteristic comprises a gain of the signal;

wherein the data at a pre-determined range of frequencies comprises impedance data, wherein determining the signal characteristic for the signal based on the data comprises:

determining whether or not the impedance data includes a spike within the pre-determined range of frequencies;

if it is determined that the impedance data includes the spike, setting the gain of the signal to a first gain level; and otherwise, setting the gain of the signal to a second gain level, wherein the first gain level differs from the second gain level;

generating the signal based on the signal characteristic; and communicating the signal to the BCT.

16. The computing device of claim 15, further comprising:

after determining that the impedance data includes the spike, determining that the BCT is not in contact with a surface; and after determining that the impedance data does not include the spike, determining that the BCT is in contact with the surface.

17. The computing device of claim 16, wherein the surface comprises skin of a wearer of the BCT.

18. The computing device of claim 15, wherein the data at a pre-determined range of frequencies comprises impedance data, and wherein determining the signal characteristic for the signal based on the data comprises:

determining whether the impedance data includes a spike within the pre-determined range of frequencies; and after determining that the impedance data does include the spike, deactivating one or more components of the computing device, thereby reducing power utilized by the computing device.

* * * * *